US006915902B2

(12) United States Patent
Brouard

(10) Patent No.: US 6,915,902 B2
(45) Date of Patent: Jul. 12, 2005

(54) TOOL BAG

(75) Inventor: Roger H. Brouard, Norwalk, CT (US)

(73) Assignee: Veto Pro Pac, LLC, Norwalk, CT (US)

( * ) Notice: Subject to any disclaimer, the term of this patent is extended or adjusted under 35 U.S.C. 154(b) by 33 days.

(21) Appl. No.: 10/263,277

(22) Filed: Oct. 2, 2002

(65) Prior Publication Data

US 2004/0065573 A1 Apr. 8, 2004

(51) Int. Cl.[7] ..... B65D 85/28
(52) U.S. Cl. ..... 206/373
(58) Field of Search ..... 206/349, 372, 206/373, 375, 376, 379; 150/106, 107, 109, 110, 116; 190/102

(56) References Cited

U.S. PATENT DOCUMENTS 5,174,447 A * 12/1992 Fleming ..... 206/373
5,423,404 A * 6/1995 Shaw ..... 206/372
5,848,744 A * 12/1998 Dischner et al. ..... 206/349
5,947,286 A * 9/1999 Chau ..... 206/372
6,126,003 A * 10/2000 Brouard ..... 206/372
6,138,827 A * 10/2000 Marshall ..... 206/373
6,478,463 B2 * 11/2002 Snider ..... 206/373

* cited by examiner

*Primary Examiner*—Luan K. Bui
(74) *Attorney, Agent, or Firm*—Michaud-Duffy Group LLP

(57) ABSTRACT

A tool bag having a bag body defining an interior area and a central panel coupled to the bag body bifurcating the interior area. Openings in the bag body provide access to the interior area. A tool deflector is coupled to the central panel. At least one tool pocket is coupled to and defined in part by the tool deflector. The tool deflector is made from a suitable material such as plastic to provide a hard surface to prevent the edges of tools from damaging the central panel when placed in or removed from the tool pockets. A handle is attached to the bag body for carrying the tool bag. The tool bag provides for safe, orderly and convenient storage and transport of tools.

7 Claims, 11 Drawing Sheets

TOOL BAG

FIELD OF THE INVENTION

The present invention relates generally to tool storage devices, and in particular, to tool bags for organizing, transporting and accessing tools.

BACKGROUND OF THE INVENTION

There are presently a variety of carrying devices on the market designed to store and transport tools. For example, many companies sell rigid tool boxes that have a hinged top and a removable tray that lifts out for accessing a lower interior area designed for bulk tool storage. Other, similar tool boxes may include small drawers for storing smaller tools or parts. However, these types of tool boxes are usually designed to store tools horizontally, often resulting in a disorganized mass of tools in a single storage area in the bottom of the tool box. This arrangement can make selection and accessing of the stored tools somewhat difficult and potentially dangerous.

Another disadvantage of rigid tool boxes such as those described above is that, often, they do not conform to storage areas provided in vehicles. Usually tradesmen transport or store tool boxes in their vehicles, however, enough space for a rectangular hard tool box is often not available.

Other tool storage products available are fabric bags similar to doctor's bags having a zippered opening providing access to an inside cavity for storing tools. However, tools stored in this type of bag are also generally stored together, horizontally, in a single storage area. Inner pockets may be provided, although access to the inner pockets can be substantially restricted when the bag is full or partially full of tools.

Most fabric tool bags available offer an alternative to the rigid tool boxes described above, but do not overcome the problems associated with bulk tool storage. Also, when storing or transporting sharp tools horizontally or in pockets, in a purely fabric bag, the bag can easily be damaged by the tools.

Another tool storage system available is a bag designed to fit over an empty 5-gallon plastic bucket. This type of bag often has a variety of tool pockets designed to fit both on the inside and outside of the bucket. The bucket provides a frame and supports the tool bag. One disadvantage of this type of tool bag is that convenient storage space for a 5-gallon bucket is often quite limited in vehicles, making it difficult to transport the stored tools.

Based on the foregoing, it is the general object of the present invention to provide a tool bag that improves over, or overcomes the problems and drawbacks of the prior art.

SUMMARY OF THE INVENTION

The present invention provides a tool bag having a bag body defining an interior area and a central panel coupled to the bag body that bifurcates the interior area. Openings in the bag body provide access to the interior area of the tool bag. A tool deflector is coupled to the central panel and is made from a suitable material such as plastic for providing a hard surface. At least one tool pocket is coupled to and defined in part by the tool deflector. The tool deflector is positioned to prevent the edges of tools from damaging the bag body when placed in or removed from the tool pockets. A handle is attached to the bag body for carrying the tool bag. In the preferred embodiment, the handle is pivotally coupled to the bag body such that, the handle is movable between an upstanding position when it is gripped by a user, and a normal position wherein the handle overlies the tool bag when it is not gripped by a user. Thus, the tool bag of the present invention provides for safe, orderly and convenient storage and transport of tools.

One advantage of the present invention is that the tool pockets provide for vertical storage and easy accessibility for a large number of tools of various sizes and shapes. Additionally, the tool deflector provides a hard surface that unlike purely fabric bags will not be substantially damaged by the sharpened edges of some tools. In addition, the central panel includes a substantially rigid support member coupled thereto for providing vertical support for the bag body.

Another advantage of the present invention is that the tool pockets provide separate and individual storage areas for tools wherein the stored tools are less likely to be damaged by contact with other tools during storage or transport.

Still another advantage of the tool bag of the present invention is that the organization capability provided by the tool pockets allows one to quickly and easily, inventory and access a large quantity of tools by visually scanning the interior area of the tool bag. This also helps to prevent tools from being lost or left at a job site.

The tool pockets can be designed having specific sizes and shapes to accommodate various tools so that the appropriate tools fit snugly therein. Desirably, the tool bag has tool pockets formed in rows adjacent to and supported by the central panel wherein a first row of pockets has the tool deflector forming a rear panel thereof and a front panel which also serves as a rear panel for a next successive row of tool pockets. The rows of tool pockets can be tiered providing tool pockets for longer tools to be stored in deep pockets such as the first row of tool pockets and smaller tools to be stored in successive rows of tool pockets. The bag body can also include additional tool pockets formed on end panels interior the bag body or on exterior panels thereof.

Preferably, the bag body is manufactured from a flexible material such as nylon attached to a flat bottom member formed from a hard plastic or other substantially rigid material. The central panel can be attached approximately perpendicularly to the bottom member and include a substantially rigid support member coupled thereto so that the tool bag is supported in an upstanding position. In the preferred embodiment, the central panel is formed of two fabric panels having the substantially rigid support member retained therebetween via stitches that attach the two fabric panels together surrounding the support member.

The openings in the bag body are arranged at the periphery thereof, so that in an open position, a flap of body material is attached only on one side of the opening providing access to the entire interior area of the tool bag. The flap includes pairs of cooperating fasteners attached thereto so that the flap can fold on itself and be secured in one or more positions when the tool bag is open. At least one opening is provided to access each of the bifurcated interior areas. Zippers are provided as closures for the openings. In this arrangement, stored tools are presented in an organized manner for convenient access by a user. Also, the tools are maintained in better condition when compared to tools stored in bulk storage tool boxes.

An ergonomically designed handle is attached to the bag body and includes a soft grip to provide comfort to the user when carrying the tool bag.

These and other features, aspects, and advantages of the present invention will become better understood with reference to the following description, drawings and appended claims.

DETAILED DESCRIPTION OF THE PREFERRED EMBODIMENT

Figure 1:
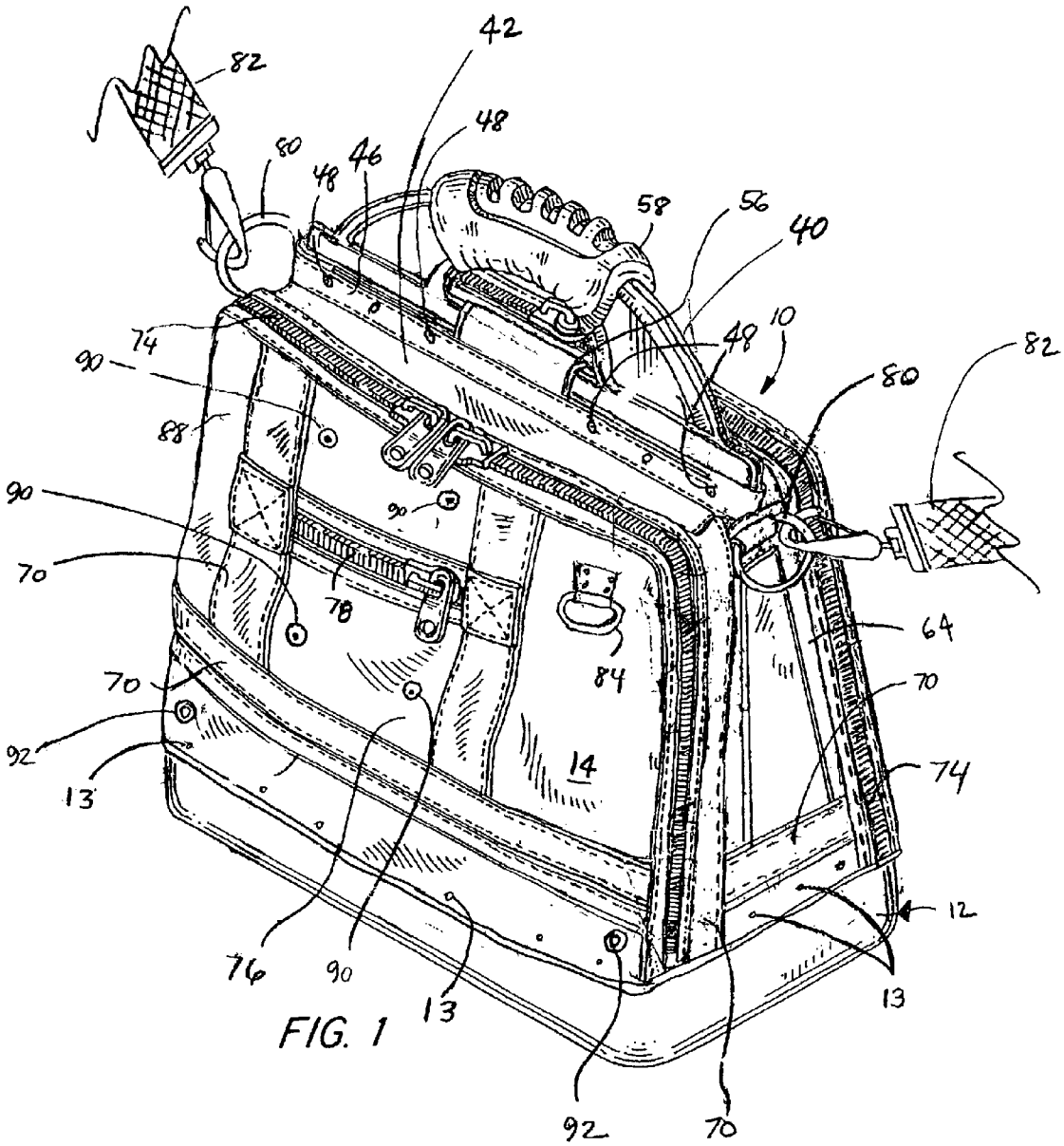
FIG. 1 is a perspective view of a tool bag according to the present invention.
Figure 2:
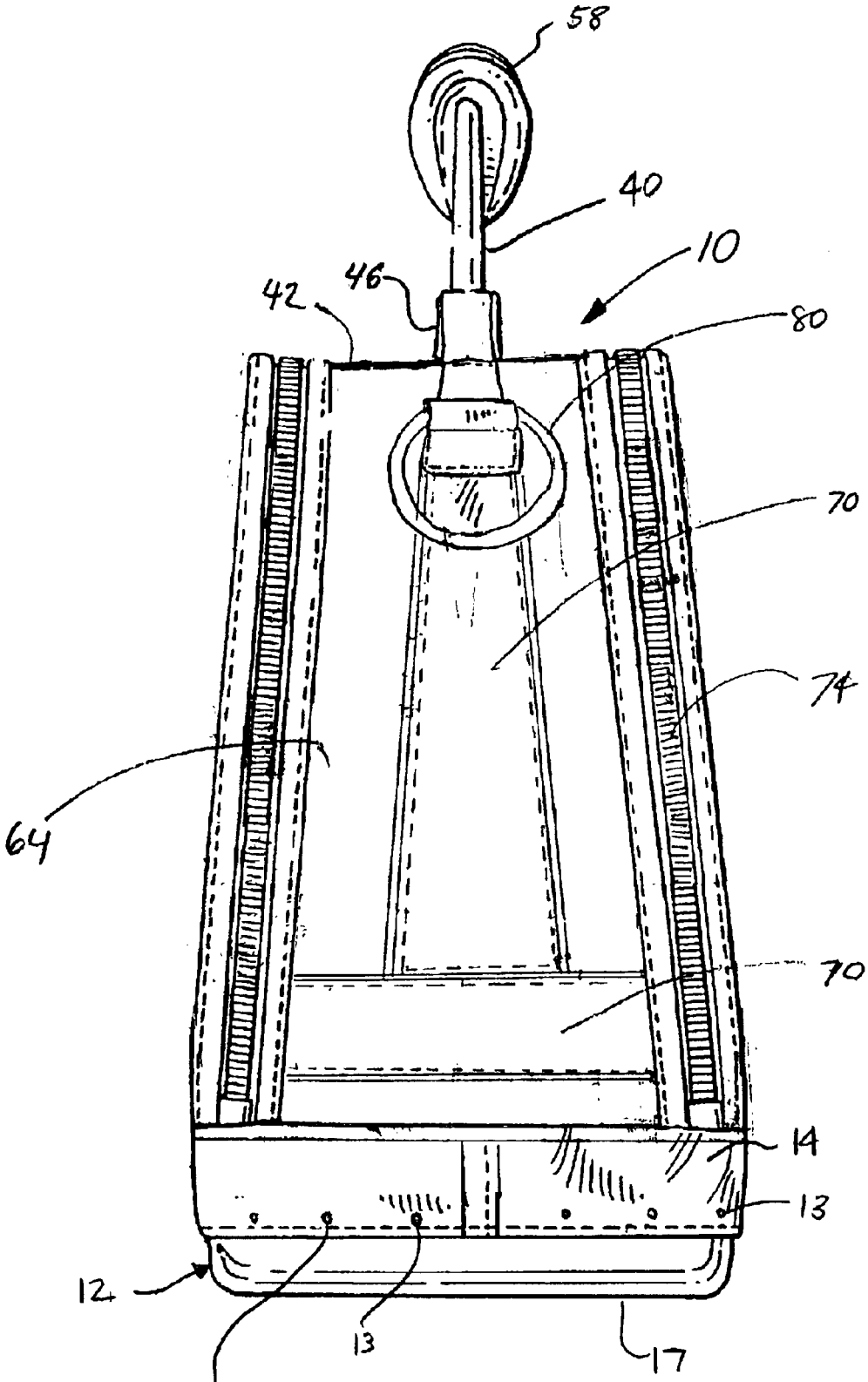
FIG. 2 is a side view of the tool bag of FIG. 1.

As shown in FIGS. 1–5 a tool bag generally designated by the reference numeral 10 comprises a bottom member generally, 12 and a bag body generally designated by the reference numeral 14. FIG. 2 shows the bag body 14 attached to the bottom member 12 via fasteners 13.

Figure 3A:
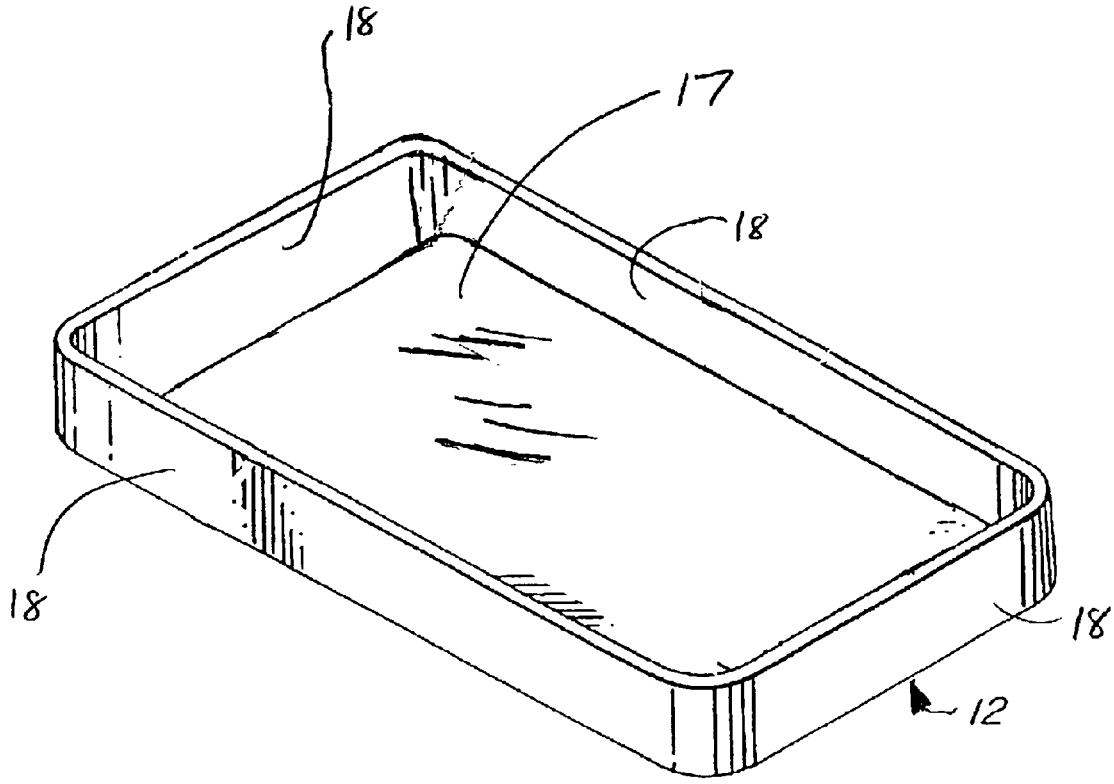
FIG. 3A is a perspective view of the bottom member of the tool bag of FIG. 1.
Figure 3B:
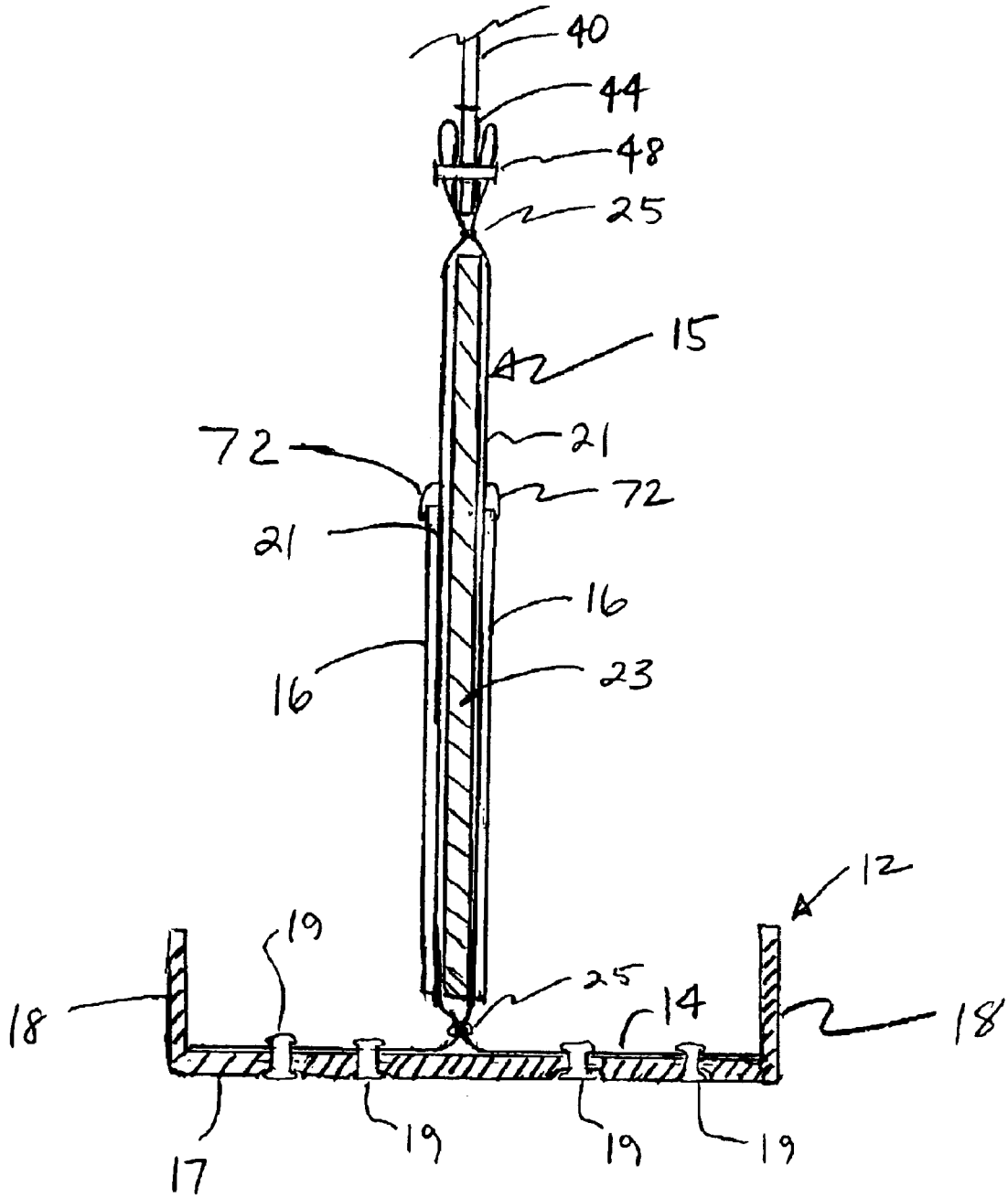
FIG. 3B is a partial cross-sectional end view of the tool bag of FIG. 1.
Figure 4:
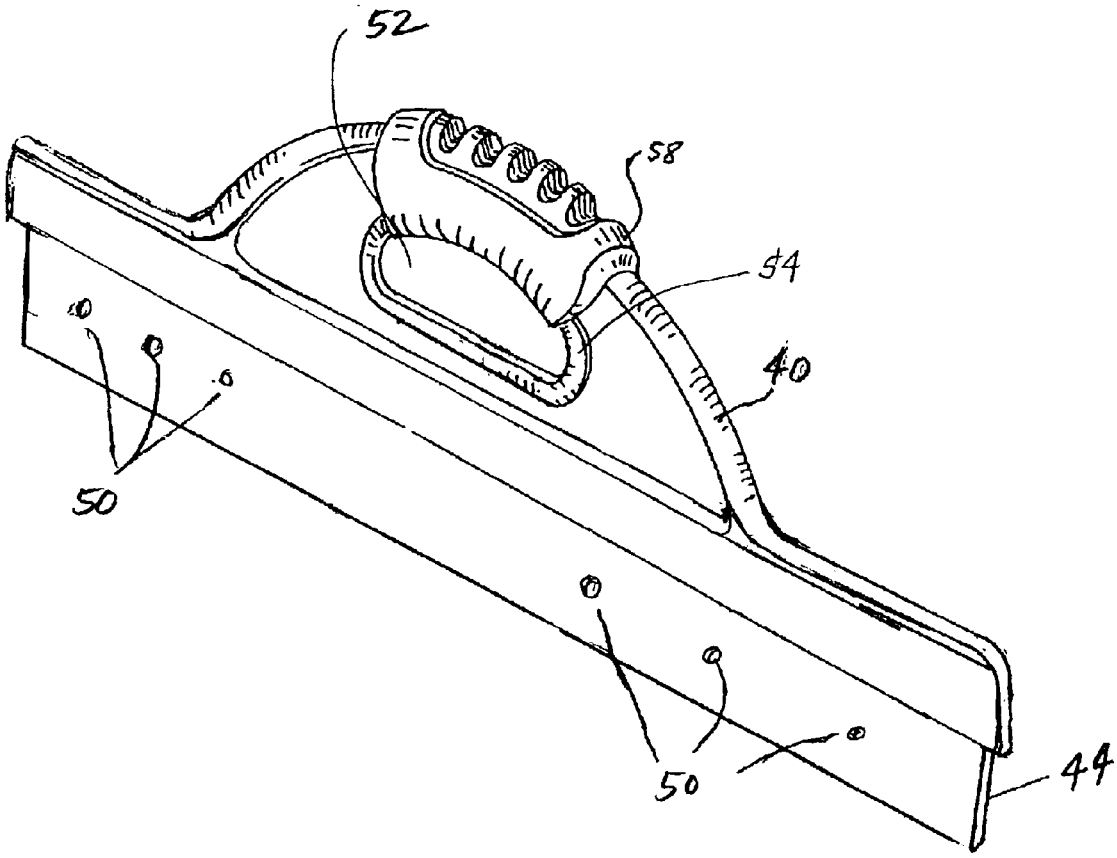
FIG. 4 is a perspective view of the handle of the tool bag of FIG. 1.

Referring to FIG. 3A, the bottom member 12 is formed in the shape of a tray having a substantially flat bottom portion 17 and upstanding walls 18. FIG. 3B shows the bag body 14 having a central panel 15 attached to the bottom member 12 such that the central panel is secured substantially perpendicular to the bottom member 12. A plurality of rivets 19 attach the central panel 15 to the bottom member 12. The central panel 15 includes two fabric panels 21 having a substantially rigid support member 23 retained therebetween via stitches 25. A tool deflector 16 is secured to the central panel 15 on either side thereof adjacent a first row of tool pockets 30 shown in FIG. 5. (FIG. 3B does not include the tool pockets.) The tool deflector 16 is constructed of an impact resistant plastic material. Alternatively, the bottom member 12 and support member 23 could be formed in one piece.

Still referring to FIGS. 1–5, the central panel 15 bifurcates the interior area 26 formed by the bag body 14 and the design and construction of the tool bag 10 on each side of the central panel is approximately identical. However, the present invention is not limited in this regard as each side of the bifurcated interior area 26 could have features different from the other side. For example, in another embodiment of the tool bag 10, the area on one side of the central panel 15 defines a single storage area while the other side has a plurality of tool pockets. The description provided herein describes the preferred embodiment of the tool bag 10 wherein the interior area 26 is approximately identical on either side of the central panel 15, thus, the interior area will be explained with reference to only one side thereof.

The bag body 14 is preferably manufactured from a ballistic nylon material for strength and durability, however any flexible material such as leather or fabric could be utilized.

Figure 5:
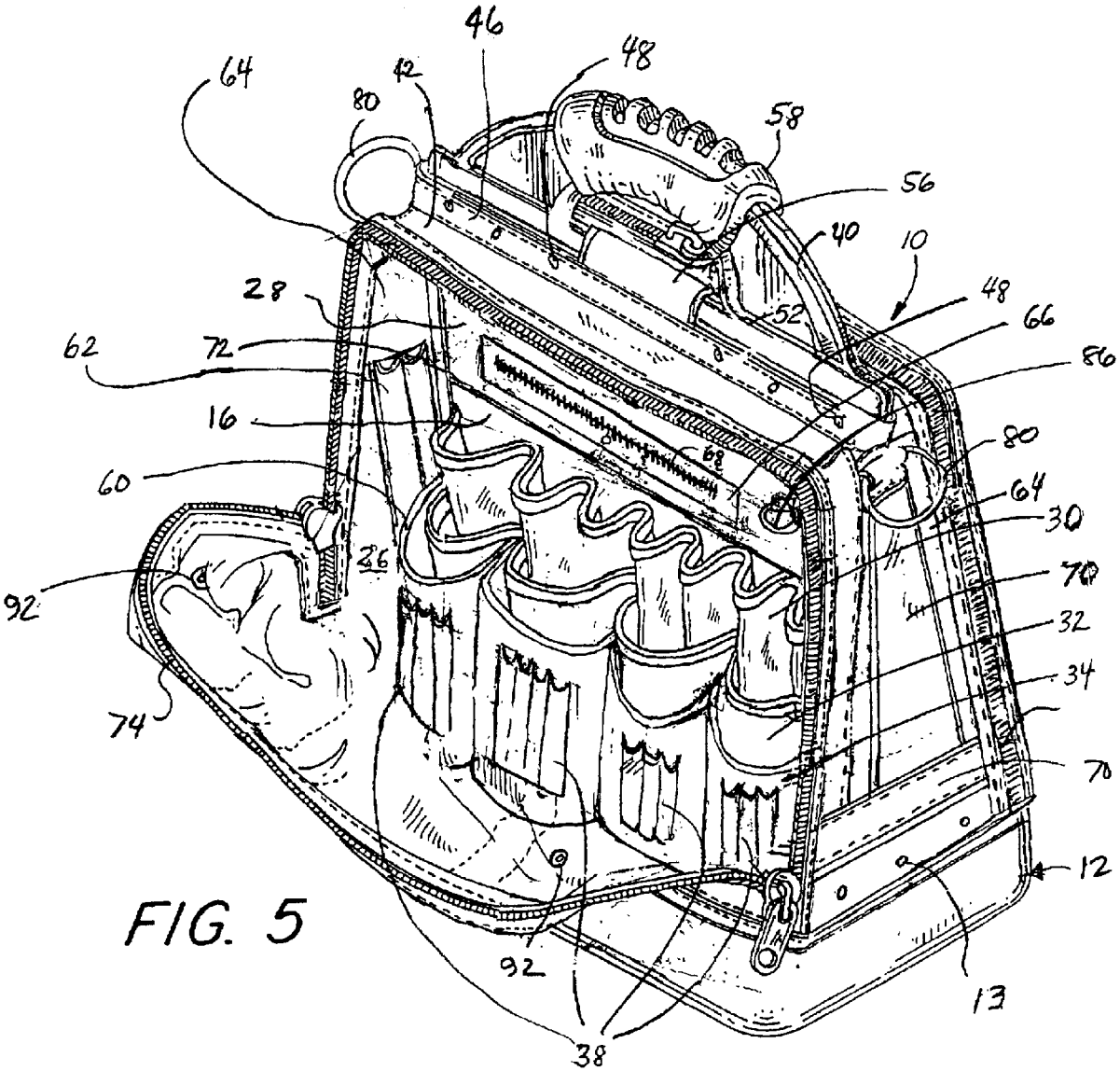
FIG. 5 is a perspective view of the tool bag of FIG. 1 in an open position.
Figure 6:
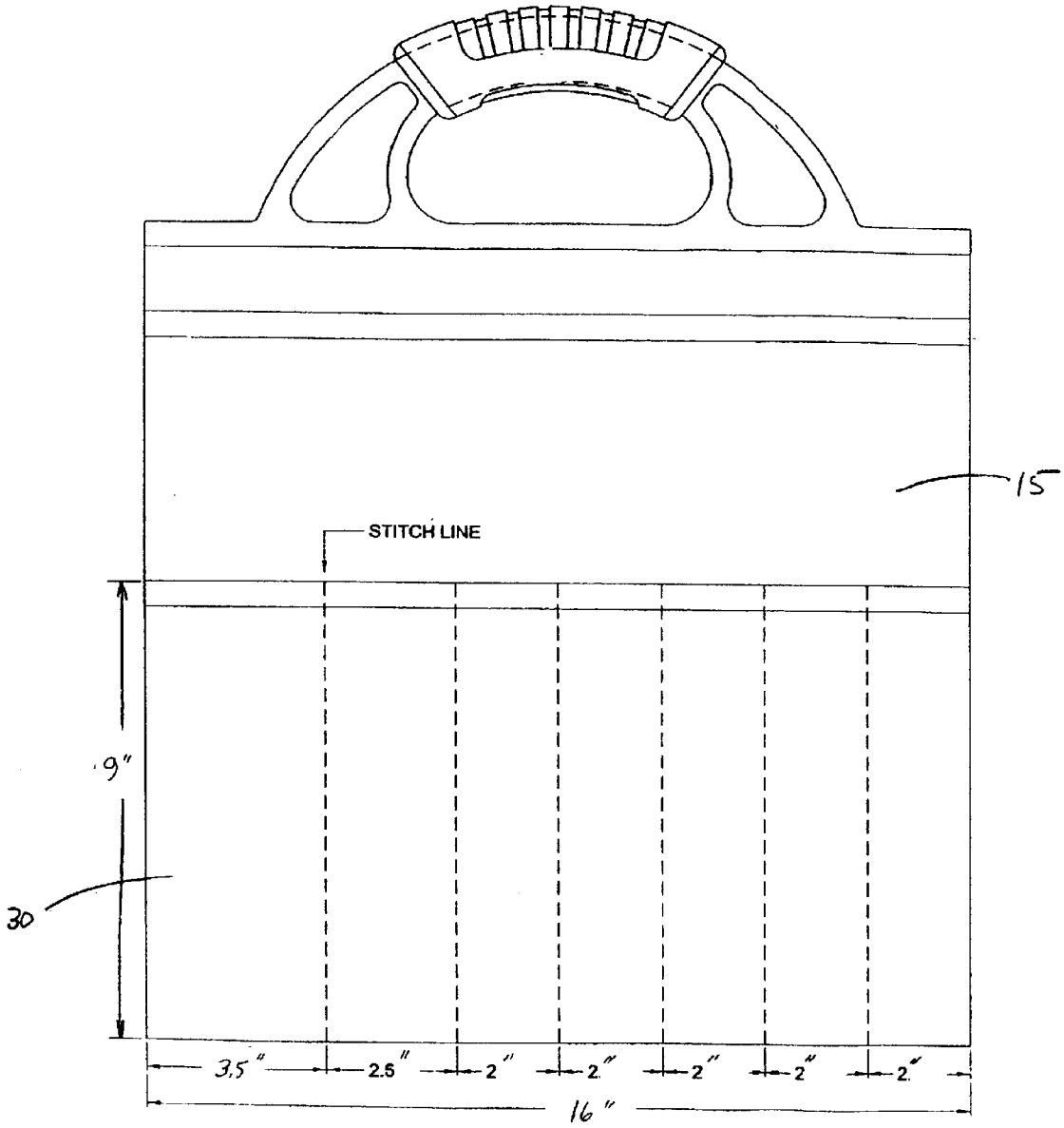
FIG. 6 is an illustration showing the size of a first row of tool pockets in a preferred embodiment of the present invention.

First, second and third rows of tool pockets, 30, 32 and 34 are coupled to the central panel 15 and tool deflector 16. The first row 30 is defined in part by the tool deflector 16 wherein the tool deflector forms a rear wall of the first row of tool pockets 30. The tool deflector 16 provides a hard surface to prevent damage to the central panel 15 of the bag body 14 when tools are inserted or removed from the first row of tool pockets 30. As such, the tool deflector 16 is preferably manufactured from an impact resistant material such as plastic. Each successive row 32 and 34 of tool pockets is defined in part by a front panel of the preceding row as shown in FIG. 5. The rows of tool pockets 30, 32 and 34 are each constructed by stitching a panel of material to the central panel 15 in an undulating fashion so as to create each of the rows of tool pockets. In the preferred embodiment the rows of tool pockets 30, 32 and 34 are tiered wherein the first row of tool pockets 30 has an overall height greater than the overall height of the second row of tool pockets 32. Accordingly, the third row of tool pockets 34 has an overall height less than the overall height of the second row 32. A fourth row of tool pockets 38 is attached to and defined in part by the front panel of the tool pockets in row 34.

Referring again to FIGS. 1–5, a handle 40 is attached to a top surface 42 of the bag body 14. The handle 40 has a lower portion 44 disposed in a pocket 46 attached to the central panel 15 and top surface 42 of the bag body 14. Fasteners 48 are secured through the apertures 50 defined by the lower portion 44 of the handle 40 and attach the handle to the tool bag 10. The handle 40 defines an opening 52 through which a hand of the user can be inserted in to carry the tool bag 10. The opening 52 has an enlarged rib 54 for providing structural support thereto. A strap 56 extends through the opening 52 and is attached to each side of the pocket 46 to further attach the handle 40 to the bag body 14. The pocket 46 could consist of only two flaps of body material attached to the handle 40. An ergonomically styled, molded grip 58 is formed through and adjacent the opening 52 to provide comfort to the user when carrying the tool bag 10.

Depending on a particular trade or the types of tools the tool bag is designed to accommodate, each of the rows of tool pockets, 30, 32, 34 and 38 can be arranged accordingly. In FIGS. 6–9, a first row of tool pockets, 30 has an overall height of approximately 9 inches and a width defined by the distance between the stitch lines attaching the tool pockets to the central panel 15, of approximately 2, 2.5 or 3.5 inches. The depth of the tool pockets in row 30 is approximately 1 inch measured outwardly from the central panel 15. The following references to the height, width and depth of the tool pockets are all measured in the same manner as discussed above with reference to the first row of tool pockets 30.

In other embodiments of the invention, the first row of tool pockets 30, ranges in height between approximately 8 inches to about 10 inches, in width, between approximately 1 inch to about 4 inches and the depth of the pockets ranges between approximately 0.75 inches to about 2 inches.

Figure 7:
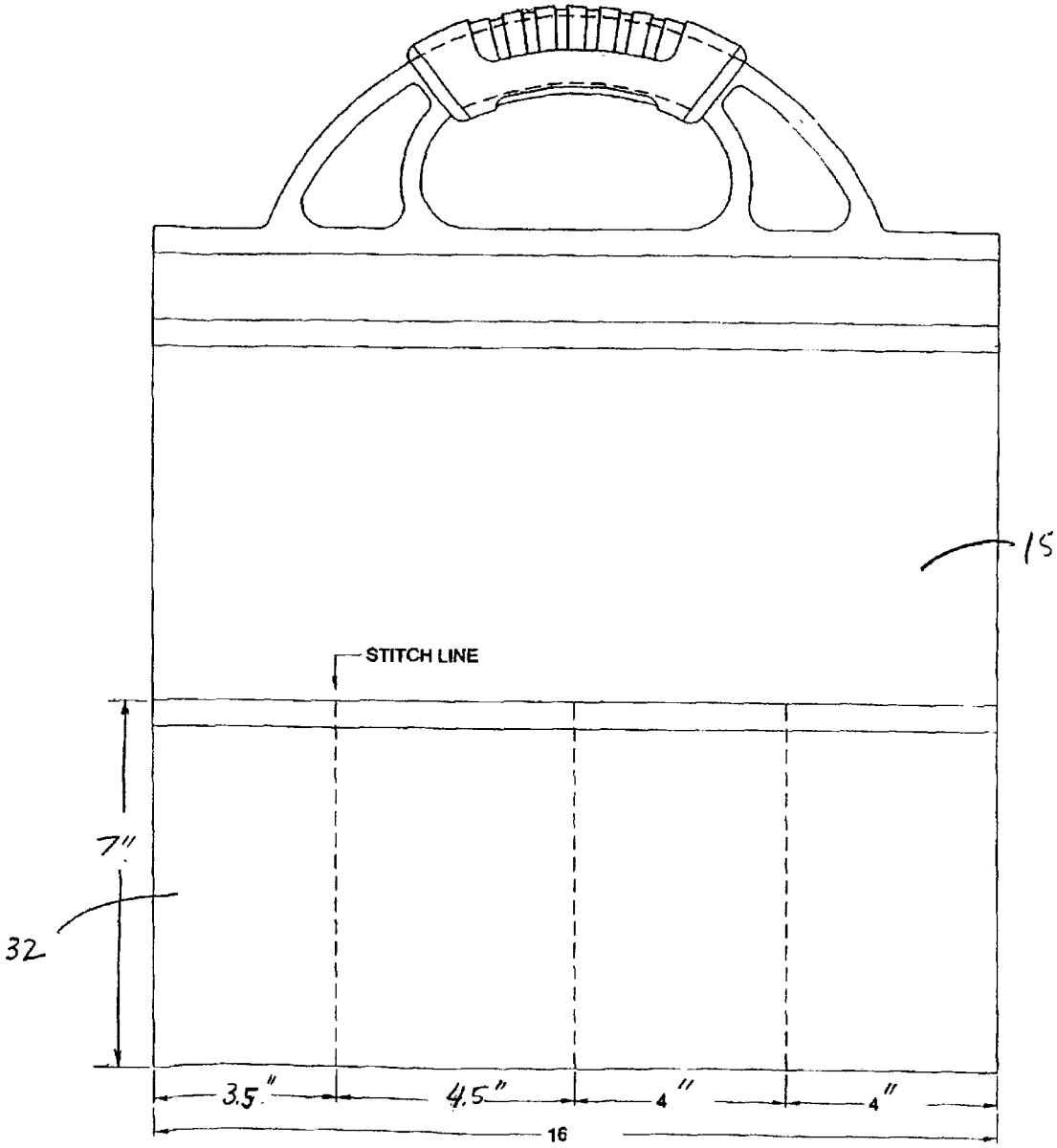
FIG. 7 is an illustration showing the size of a second row of tool pockets in a preferred embodiment of the present invention.
Figure 9:
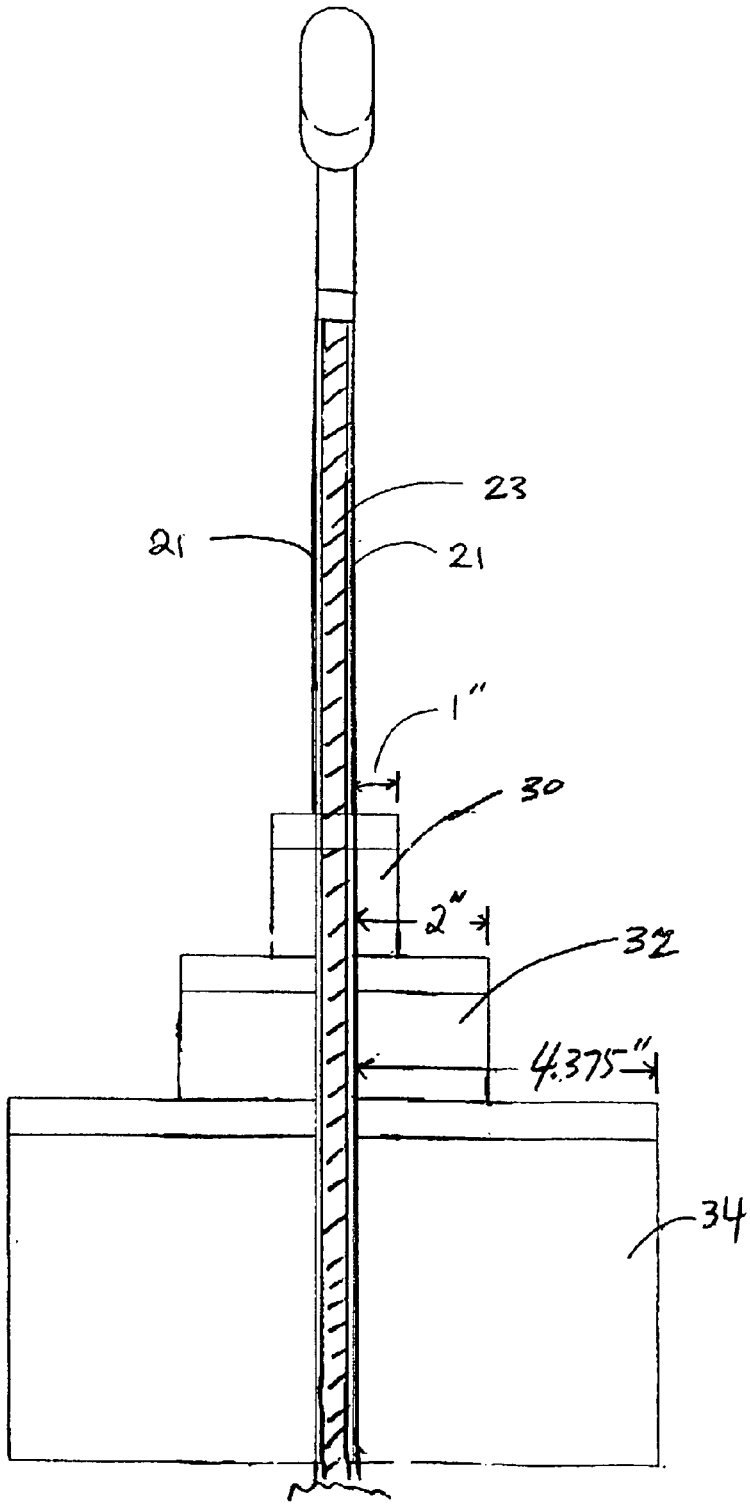
FIG. 9 is an illustration showing the depth of the rows of tool pockets in a preferred embodiment of the present invention.

Referring to FIGS. 7 and 9, the preferred embodiment has a second row of tool pockets 32 having an overall height of approximately 7 inches and a width of approximately 3.5, 4 or 4.5 inches. As shown in FIG. 9, the depth of the tool pockets in row 32 is approximately 2 inches as measured outwardly from the central panel 15. In other embodiments the second row of tool pockets, 32 ranges in height between approximately 6 inches to about 8 inches, in width between approximately 3 inches to about 6 inches and the depth of the pockets ranges between approximately 1.5 inches to about 3 inches.

Figure 8:
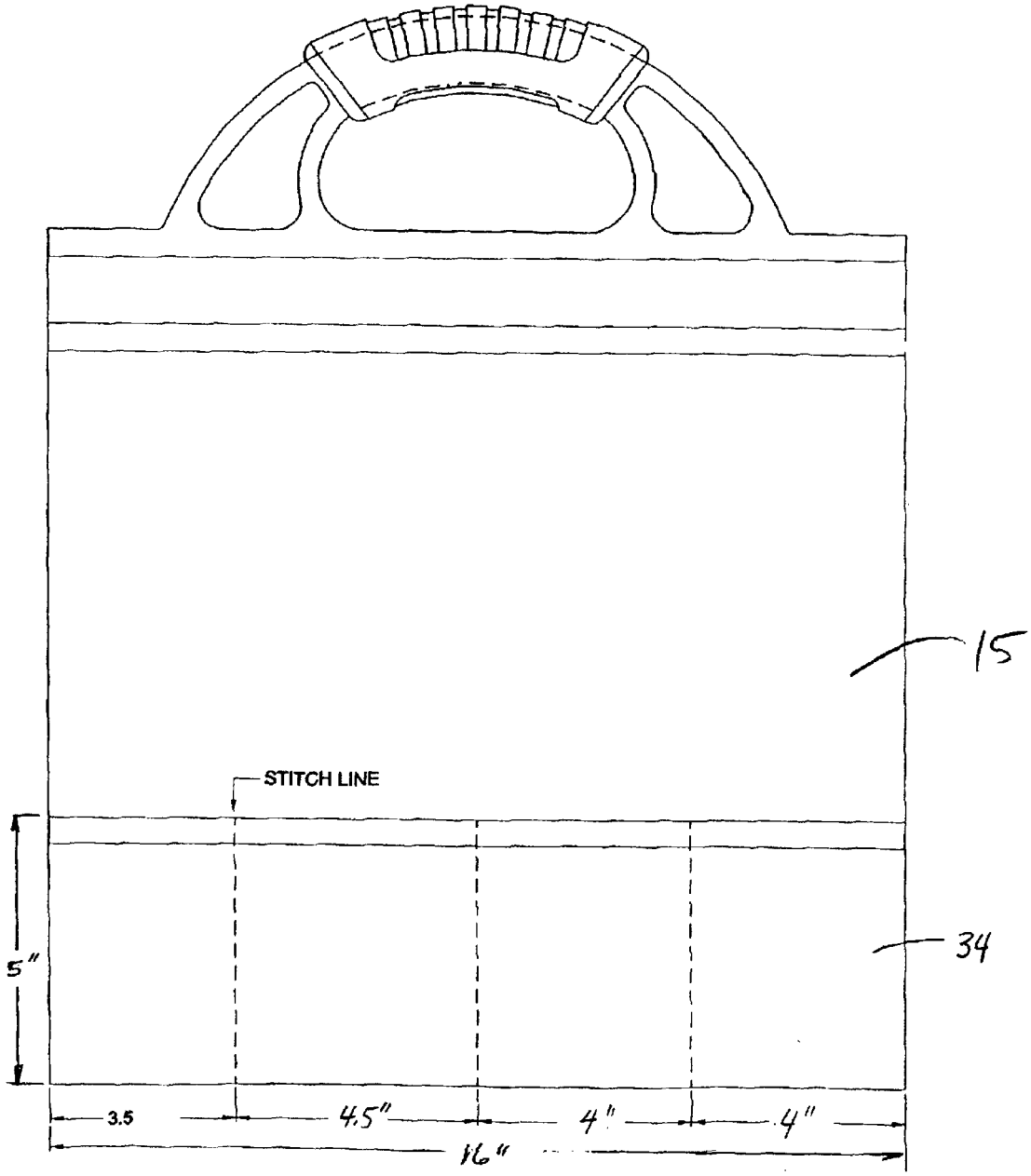
FIG. 8 is an illustration showing the size of a third row of tool pockets in a preferred embodiment of the present invention.

Referring to FIGS. 8 and 9, in the preferred embodiment, a third row of tool pockets 34 has an overall height of approximately 5 inches and a width of approximately 3.5, 4 or 4.5 inches. As shown in FIG. 9, the depth of the tool pockets in row 34 is approximately 4.375 inches. In other embodiments of the invention, a third row of tool pockets, 34 ranges in height between approximately 4 inches to about 6 inches, the width of the tool pockets is approximately 3 inches to about 6 inches and the depth of the pockets ranges between approximately 3 inches to about 6 inches.

As discussed hereinabove, in the preferred embodiment of the invention, the first, second and third rows of tool pockets 30, 32 and 34 are tiered allowing for longer tools (e.g. chisels, screwdrivers) to be stored in the taller pockets in the first row of tool pockets 30, and smaller or shorter tools to be stored in the second and third rows of tool pockets, 32 and 34. The tiered configuration of the tool pockets allows most tools to be stored vertically for easy accessibility. Each of the rows of tool pockets 30, 32 and 34 has a finishing strip 60 along the top edge thereof.

Referring to FIG. 5, a row of pockets 38 is attached to and defined in part by the preceding row of tool pockets 34. Tool pockets 62 are attached to and defined in part by the end panel 64. A tool pocket 66 having a zipper closure 68 is attached to and defined in part by the central panel 15 of the bag body 14.

As shown in FIG. 1, the bag body 14 has reinforcement straps 70 sewn on all sides thereof providing additional support and durability to the bag body. A trim strip 72 is stitched to the central panel 15 and an upper edge of the tool deflector 16 providing additional support as well as a decorative trim thereto. Zipper closures 74 are disposed at the openings of each of the bifurcated areas of the bag body 14. In the FIG. 1 embodiment, the openings in the bag body 14 for accessing the interior area 26 are dispsosed at a periphery of the bag body 14.

Referring again to FIG. 1, a tool pocket 76 is attached to and defined in part by an outer surface of the bag body 14. The tool pocket 76 has a zipper 78 providing a closure mechanism at the opening thereof. Attached to the end panels 64 of the bag body 14 are rings 80 for securing a detachable carrying strap 82 to the tool bag 10. Referring to FIGS. 1 and 5, rings 84 and 86 are attached to the cover panel 88 and the central panel 15 respectively, for securing articles to the both the exterior and interior of the tool bag 10. In other embodiments of the invention, other types of couplers could be utilized in place of the rings 84 and 86 for attaching articles to the tool bag 10.

Figure 10:
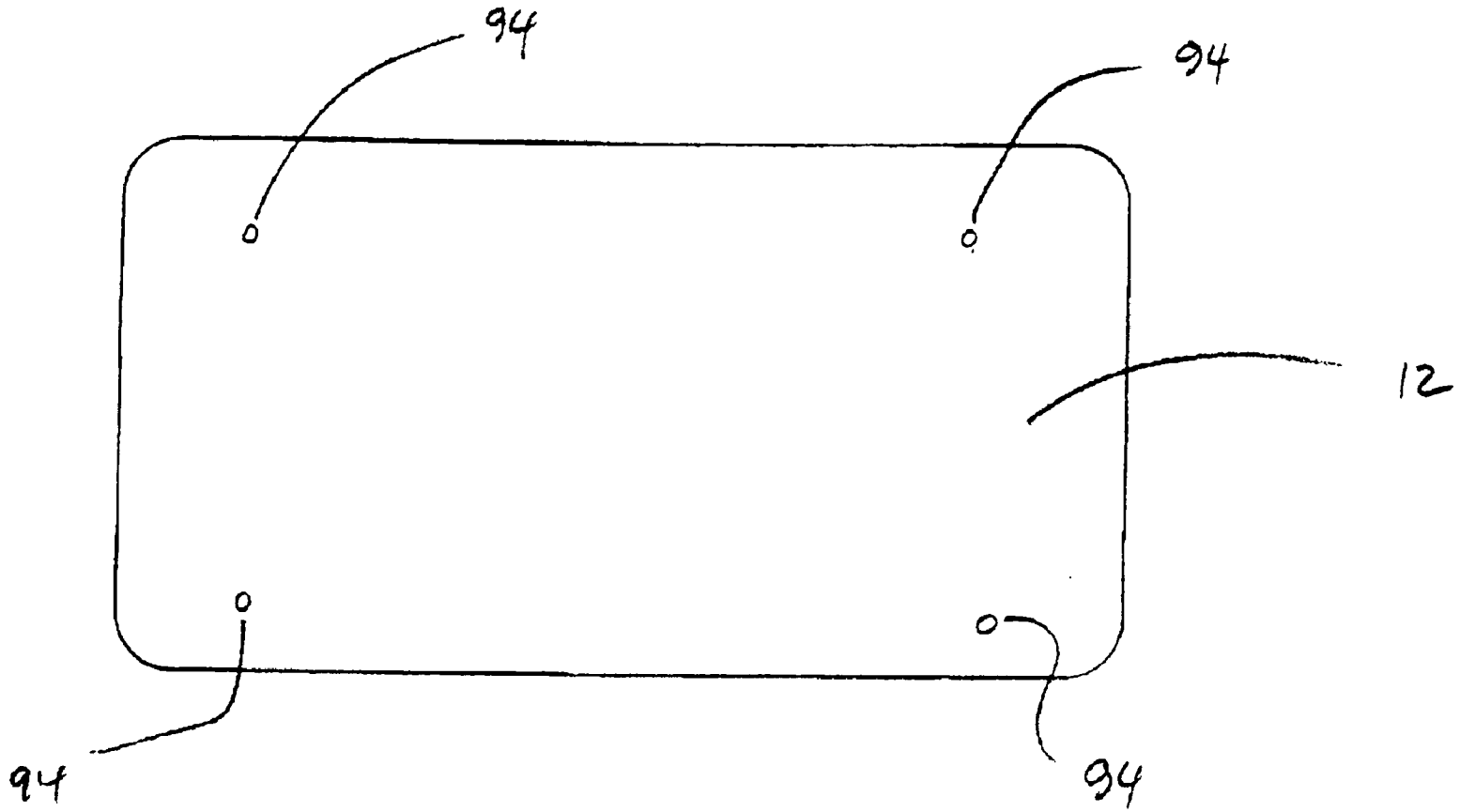
FIG. 10 is a bottom side view of a bottom member of the present invention.

Referring to FIG. 10, the bottom member 12 defines frangible areas 94 forming optional drains for the interior area 26. These frangible areas 94 could be broken away by a user should drainage of the interior be desired. Alternatively, drain openings could be provided in the bottom member 12 of the tool bag 10.

A user of the tool bag 10 of the present invention can open one or both of the cover panels 88 of the bag body 14 by unzipping the zippers 74 thereby providing access to each of the bifurcated interior areas of the tool bag. (FIG. 5 shows the tool bag 10 having one of the cover panels 88 in an open position). Each cover panel 88, when in an open position, can be folded on itself and secured adjacent the lower portion of the bag body using one or both pairs of snap fasteners 90 and 92. This retains the cover panel 88 in a secured position while the tool bag 10 is in an open position and prevents damage to the cover panel and the zipper 74.

Once opened, the various pockets formed by the first, second, third and fourth rows of tool pockets 30, 32, 34 and 38 as well as the tool pockets 62 and 66 can be loaded with tools. The tiered configuration of the tool pockets allows the tools to be stored vertically for easy accessibility and inventory. Tools and other items can be also stored in the tool pockets 76 located on the cover panels 88. Once the tool bag 10 is loaded, the cover panels 88 can be returned to their closed position using the zipper closure members 74 (see FIG. 1). In the closed position, the tools are retained in the tool pockets interior the tool bag 10 in such a way that the tools will not come out of the tool pockets during carrying and transport of the tool bag even in the event the tool bag is accidentally knocked over onto a side thereof. The central panel 15 and support member 23 also help balance the load of tools so that the tool bag 10 can be easily carried by the user.

Thus, it can be seen from the foregoing specification and attached drawings that the tool bag of the present invention provides an effective means for carrying and accessing tools stored therein. It is believed that the many advantages of this invention will now be apparent to those skilled in the art. It will also be apparent that a number of variations and modifications may be made to the tool bag without departing from the spirit and scope of the invention. Accordingly, the foregoing description is to be construed as illustrative only, rather than limiting.

What is claimed is:

1. A tool bag comprising:

a bag bottom having a flat surface;

a bag body extending from a periphery of the bag bottom, the bag body coupled to the bag bottom and including at least one fabric body portion positioned substantially centrally of and extending from said bag bottom, said at least one fabric body portion being non-removably coupled to said bag bottom;

said fabric body portion forming in-part at least one interior area, and having a plurality of pockets, at least one of said pockets being positioned within another of said pockets such that an outer surface of said at least one of said pockets forms an inner surface of said another of said pockets, each of said pockets being at least partially coupled to said fabric body portion;

said bag body further including a central, generally rigid panel-like member positioned adjacent to said at least one fabric body portion and extending substantially normal to said bag bottom, said rigid panel-like member being cooperative with said fabric body portion to bifurcate an interior area defined by said fabric body portion into only two interior compartments; and a single handle hingedly attached to said fabric body portion of said bag body and positioned centrally of, longitudinally along, and extending outwardly from a top outermost surface defined by said bag body, said handle being movable relative to said top outermost surface and movable relative to said central panel.

2. A tool bag as defined by claim 1 wherein said bag body is coupled to said bag bottom.

3. A tool bag as defined by claim 1 wherein at least a portion of said bag bottom is substantially rigid.

4. A tool bag as defined by claim 1 wherein said bag body defines at least two zippers each for at least partially closing said bag body.

5. A tool bag as defined by claim 1 wherein said pockets of said plurality of pockets are arranged in rows.

6. A tool bag as defined by claim 1, wherein said bag body is operably openable so that at least one of said interior areas is exposed, and wherein said bag body defines at least one flap when in an open position.

7. A tool bag as defined by claim 1, wherein a grip is formed through and adjacent an opening of said single handle.

* * * * *